US011720047B2

(12) United States Patent
Minamoto et al.

(10) Patent No.: US 11,720,047 B2
(45) Date of Patent: Aug. 8, 2023

(54) CHARGE ELIMINATION CONFIGURATION FOR IMAGE FORMING APPARATUS

(71) Applicant: KYOCERA Document Solutions Inc., Osaka (JP)

(72) Inventors: Riku Minamoto, Osaka (JP); Takashi Kusukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/740,242

(22) Filed: May 9, 2022

(65) Prior Publication Data

US 2022/0365476 A1 Nov. 17, 2022

(30) Foreign Application Priority Data

May 13, 2021 (JP) ..... 2021-081773

(51) Int. Cl.
*G03G 21/06* (2006.01)

(52) U.S. Cl.
CPC ..... *G03G 21/06* (2013.01)

(58) Field of Classification Search
CPC .. G03G 21/08; G03G 15/0291; G03G 15/047; G03G 21/06
See application file for complete search history.

(56) References Cited

U.S. PATENT DOCUMENTS 9,207,623 B2 12/2015 Kamiyama
2011/0020034 A1* 1/2011 Tsutsumi ..... G03G 21/08 399/128
2013/0136499 A1* 5/2013 Kamiyama ..... G03G 21/0005 399/128
2015/0023696 A1* 1/2015 Hayashi ..... G03G 21/08 399/128
2017/0315464 A1* 11/2017 Oi ..... G03G 21/08

FOREIGN PATENT DOCUMENTS

JP 2013-113901 A 6/2013

* cited by examiner

*Primary Examiner* — Jessica L Eley
(74) *Attorney, Agent, or Firm* — Studebaker & Brackett PC

(57) ABSTRACT

An image forming apparatus includes a transfer belt and a plurality of image forming units. The image forming unit includes a photosensitive drum and a charge elimination part. The charge elimination part of a predetermined image forming unit irradiates a downstream area of the primary transfer position on the photosensitive drum of the predetermined image forming unit with post-transfer charge elimination light and irradiates an upstream area of a primary transfer position on the photosensitive drum of the other image forming unit disposed on a downstream side of the predetermined image forming unit in the conveyance direction. A slit part is provided between the predetermined image forming unit and the other image forming unit for narrowing an irradiation width of the pre-transfer charge elimination light in a circumferential direction of the photosensitive drum.

4 Claims, 5 Drawing Sheets

CHARGE ELIMINATION CONFIGURATION FOR IMAGE FORMING APPARATUS

INCORPORATION BY REFERENCE

This application is based on and claims the benefit of priority from Japanese patent application No. 2021-081773 filed on May 13, 2021, which is incorporated by reference in its entirety.

BACKGROUND

The present disclosure relates to an image forming apparatus.

An electrophotographic image forming apparatus employs a secondary transfer system. In the secondary transfer system, the surface of the photosensitive drum is charged, an electrostatic latent image is formed on the surface of the photosensitive drum by exposure, and toner adheres to the electrostatic latent image to form a toner image. Then, the toner image is primarily transferred from the photosensitive drum to the intermediate transfer belt, and further, the toner image is secondarily transferred from the intermediate transfer belt to the sheet. After the primary transfer, the photosensitive drum is irradiated with post-transfer charge elimination light, but if the electrostatic latent image remains on the surface of the photosensitive drum, a transfer failure of the toner image may occur at the next primary transfer.

For this reason, an image forming apparatus is proposed, in which a photosensitive drum is irradiated with post-transfer charge elimination light after the primary transfer and the photosensitive drum is irradiated with pre-transfer charge elimination light before the primary transfer. In this image forming apparatus, a plurality of the photosensitive drums are disposed in the conveyance direction of the transfer belt, and a charge elimination part is provided on the downstream side of the primary transfer position of each photosensitive drum. After the primary transfer, the downstream side portion of the primary transfer position of the photosensitive drum is irradiated with post-transfer charge elimination light from the charge elimination part, and before the next primary transfer, the upstream side portion of the primary transfer position of the photosensitive drum is irradiated with pre-transfer charge elimination light from the other charge elimination part provided on the upstream side in the conveyance direction.

However, if the amount of the pre-transfer charge elimination light is too large or too small, the transfer failure cannot be sufficiently prevented. In addition, when adjusting the amount of the pre-transfer charge elimination light, there is a limit only by adjusting the amount of current to the charge elimination part.

SUMMARY

In accordance with an aspect of the present disclosure, an image forming apparatus includes a transfer belt and a plurality of image forming units. The transfer belt travels in a predetermined conveyance direction. The plurality of image forming units are arranged in the conveyance direction. The image forming unit includes a photosensitive drum and a charge elimination part. The photosensitive drum rotates in contact with the transfer belt at a primary transfer position. The charge elimination part eliminates a charge of the photosensitive drum on a downstream side of the first transfer position. The charge elimination part of a predetermined image forming unit among the image forming units irradiates a downstream area of the primary transfer position on the photosensitive drum of the predetermined image forming unit with post-transfer charge elimination light and irradiates an upstream area of the primary transfer position on the photosensitive drum of the other image forming unit disposed on a downstream side of the predetermined image forming unit in the conveyance direction. A slit part is provided between the predetermined image forming unit and the other image forming unit for narrowing an irradiation width of the pre-transfer charge elimination light in a circumferential direction of the photosensitive drum.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
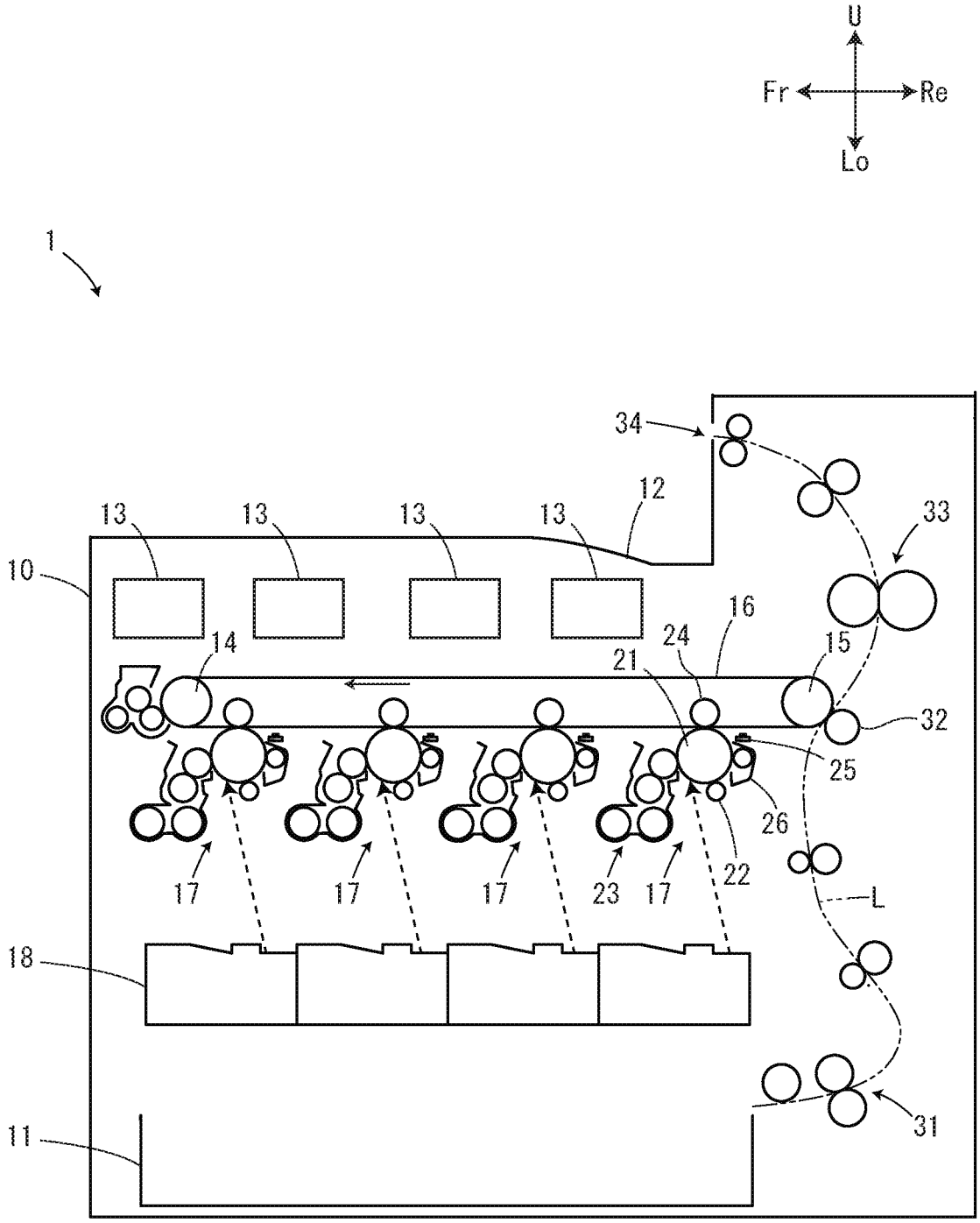
FIG. 1 is a view schematically showing a printer according to the present embodiment.

Hereinafter, with reference to the drawings, an image forming apparatus according to the present embodiment will be described. In the following description, a printer will be described as an example of the image forming apparatus. FIG. 1 is a view schematically showing the printer according to the present embodiment. Arrows Fr, Re, U and Lo appropriately attached to the respective drawings indicate the front, rear, upper, and lower sides of the printer, respectively. In the following description, A to D are added when image forming units are distinguished, and A to D are omitted when the image forming units are not distinguished.

As shown in FIG. 1, the printer 1 includes a box-shaped housing 10 in which various devices are housed. In the lower portion in the housing 10, a sheet feeding cassette 11 in which a bundle of sheets is set is housed, and in the upper portion in the housing 10, a sheet discharge tray 12 on which the sheets on which an image is formed is stacked is provided. Below the sheet discharge tray 12, a toner container 13 storing toner is detachably set for each color (for example, magenta, cyan, yellow and black) of the toner. Below the toner containers 13, an intermediate transfer belt (a transfer belt) 16 stretched around a pair of rollers 14 and 15 is provided.

Below the intermediate transfer belt 16, a plurality of image forming units 17 are arranged in the conveyance direction of the intermediate transfer belt 16. Each image forming unit 17 includes a photosensitive drum 21 rotating in contact with the intermediate transfer belt 16. Around the photosensitive drum 21, a charger 22, a development device 23, a primary transfer roller 24, a charge elimination part 25 and a cleaning device 26 are disposed in the order of the primary transfer process. To the cleaning device 26, a waste toner box (not shown) is connected. Each development device 23 is supplied with the toner from the corresponding toner container 13 through a supply passage (not shown). To the waste toner box, the waste toner is discharged from each cleaning device 26 through a discharge passage (not shown).

Below the image forming units 17, an exposure device 18 constituted by a laser scanning unit (LSU) is provided. In the side portion in the housing 10, a conveyance path L for the sheet from the sheet feeding cassette 11 to the sheet discharge tray 12 is formed by a plurality of rollers. A sheet feeding part 31 is provided on the upstream side (the lower side) of the conveyance path L, and a secondary transfer roller 32 is provided on the side end of the intermediate transfer belt 16 on the downstream side of the sheet feeding part 31 on the conveyance path L. A fixing device 33 is provided on the downstream side of the secondary transfer roller 32 on the conveyance path L, and a sheet discharge port 34 is provided on the downstream end side (the upper side) of the conveyance path L.

At a time of an image forming operation in the printer 1, after the surface of the photosensitive drum 21 is charged by the charger 22, an electrostatic latent image is formed on the surface of the photosensitive drum 21 by laser light from the exposure device 18. Next, the development device 23 supplies the toner to the electrostatic latent image on the surface of the photosensitive drum 21 to form a toner image, and the toner image is primarily transferred from the surface of the photosensitive drum 21 to the surface of the intermediate transfer belt 16. A full-color toner image is formed on the surface of the intermediate transfer belt 16 by primary transferring the toner images of respective colors to the intermediate transfer belt 16 in each image forming unit 17. The charge and the waste toner remaining on the photosensitive drum 21 are removed by the charge elimination part 25 and the cleaning device 26.

On the other hand, the sheet is fed from the sheet feeding feed cassette 11 or the manual sheet feeding tray (not shown) by the sheet feeding part 31, and is conveyed toward the secondary transfer roller 32 in timing with the above image forming operation. The full-color toner image is secondarily transferred from the surface of the intermediate transfer belt 16 to the surface of the sheet by the secondary transfer roller 32, and the sheet on which the toner image is transferred is conveyed toward the fixing device 33 on the downstream side of the secondary transfer roller 32. In the fixing device 33, the toner image is fixed on the sheet, and the sheet on which the toner image is fixed is discharged through the sheet discharge port 34 onto the sheet discharge tray 12. In the above manner, the toner image transferred to the sheet passes through the fixing device 33 to form an image on the surface of the sheet.

Further, in the printer 1, the photosensitive drum 21 is irradiated with pre-transfer charge elimination light in addition to post-transfer charge elimination light to eliminate the electrostatic latent image after the completion of the primary transfer and before the start of the next primary transfer. Because the transfer failure may occur if the amount of the pre-transfer charge elimination light is too large or too small, it is necessary to adjust the amount of the pre-transfer charge elimination light to an appropriate amount of light. However, it is difficult to appropriately adjust the amount of the pre-transfer charge elimination light only by adjusting the amount of current. Therefore, in the printer 1 of this embodiment, the irradiation width of the pre-transfer charge elimination light is narrowed by a mechanical structure such that the photosensitive drum 21 is irradiated with the pre-transfer charge elimination light having an appropriate amount of light.

Figure 2:
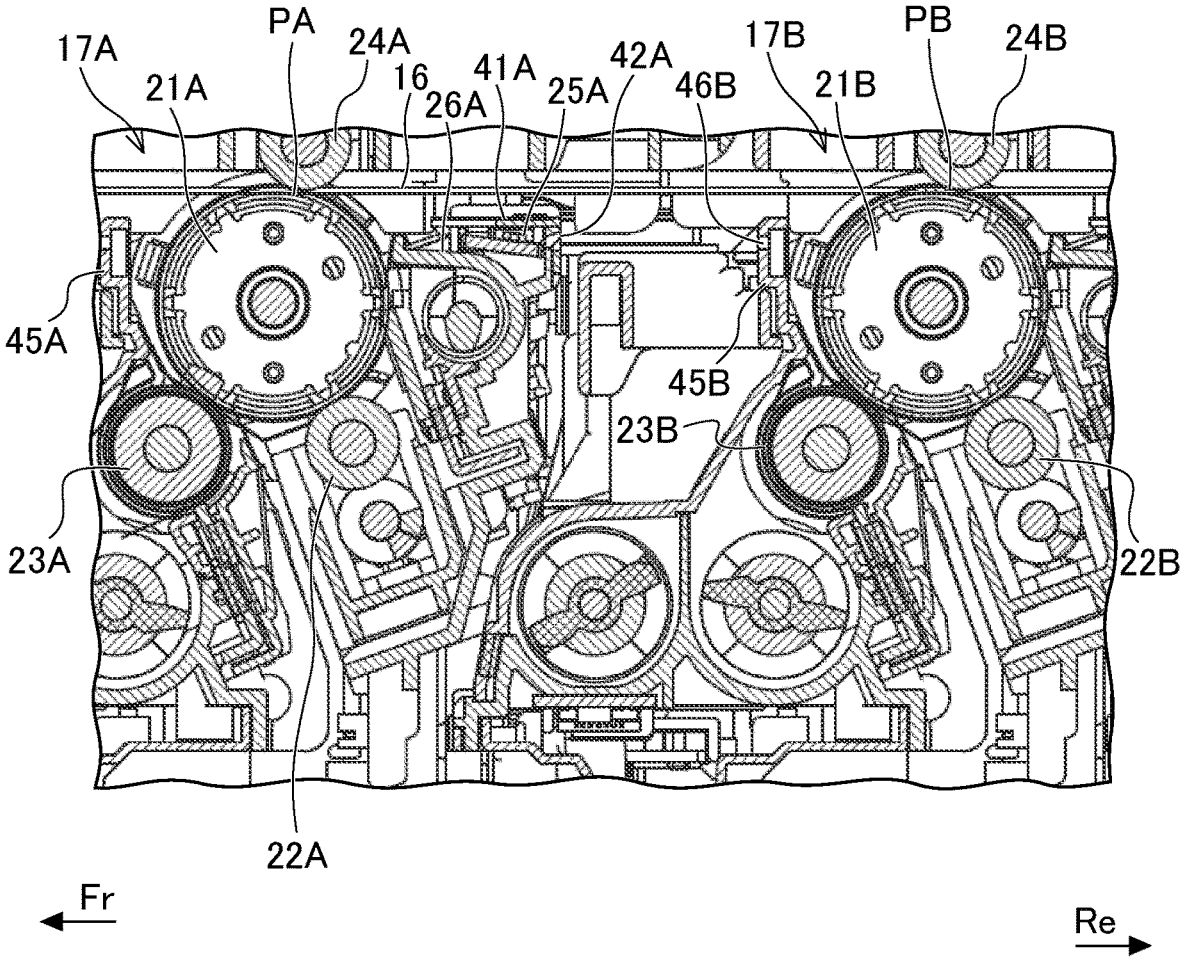
FIG. 2 is a sectional view schematically showing an image forming unit according to the present embodiment.
Figure 3:
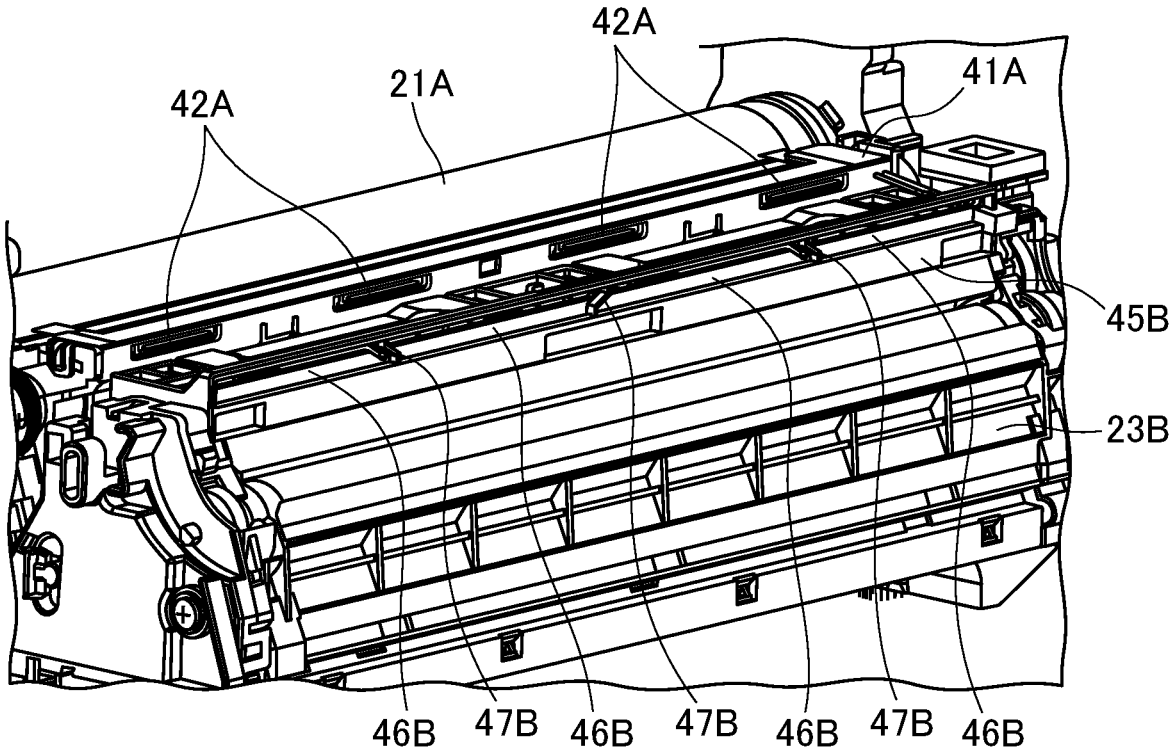
FIG. 3 is a perspective view showing the image forming unit according to the present embodiment.
Figure 4:
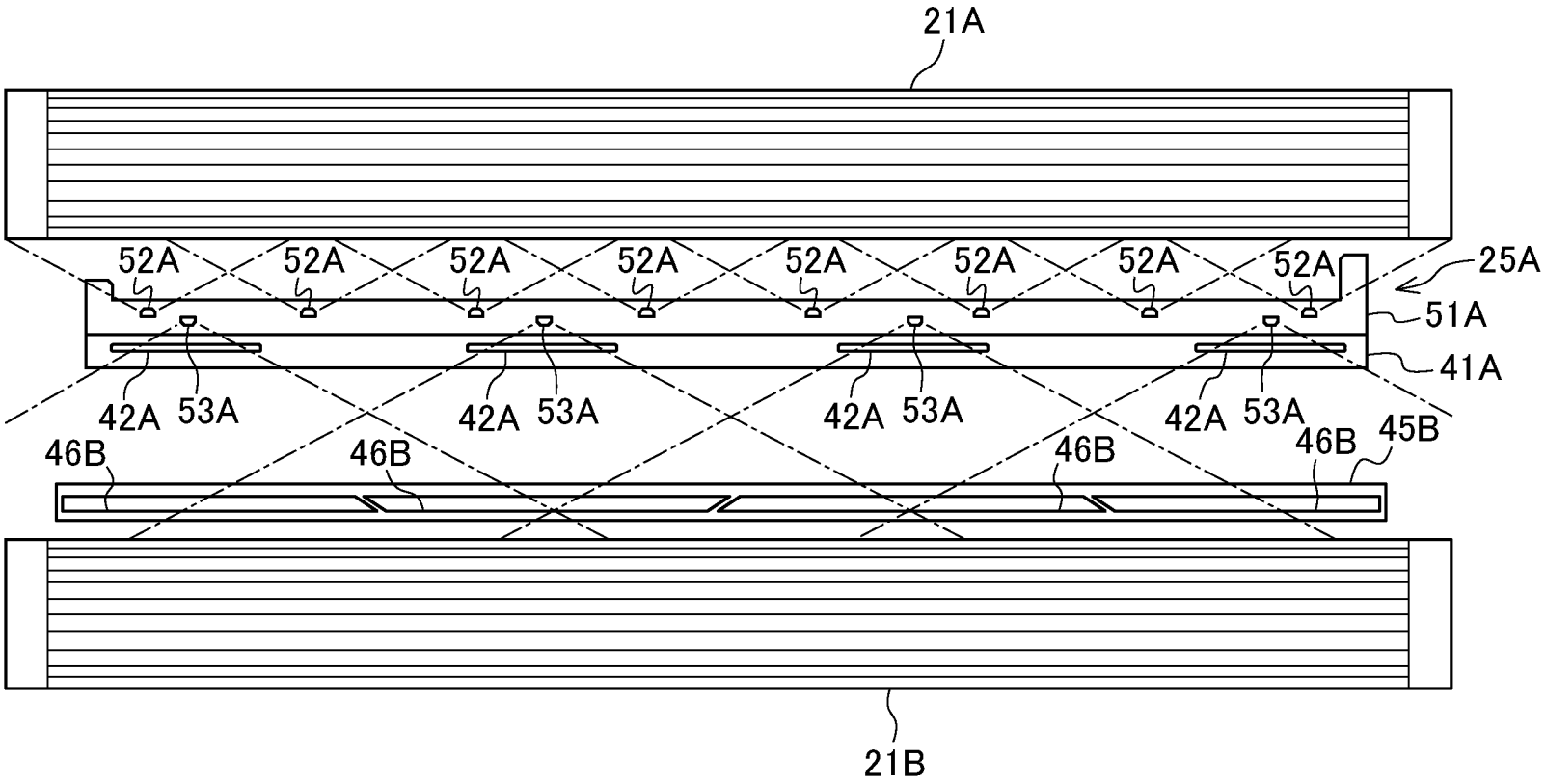
FIG. 4 is a plan view schematically showing a charge elimination part according to the present embodiment.

With reference to FIG. 2 to FIG. 4, the image forming unit will be described. FIG. 2 is a sectional view schematically showing the image forming unit of the present embodiment. FIG. 3 is a perspective view showing the image forming unit of the present embodiment. FIG. is a plan view schematically showing the charge elimination part of the present embodiment. For convenience of explanation, FIG. 3 shows the photosensitive drum, the charge elimination part of the image forming unit and the development unit of the other image forming unit disposed on the downstream side in the conveyance direction, and the other members and parts are omitted.

As shown in FIG. 2, the photosensitive drum 21A of the image forming unit 17A is rotatably supported by a drum frame 41A. A primary transfer roller 24A is provided above the photosensitive drum 21A at a primary transfer position PA across the intermediate transfer belt 16. The primary transfer roller 24A comes in rotational contact with the intermediate transfer belt 16 at the primary transfer position PA from above, and the photosensitive drum 21A comes in rotational contact with the intermediate transfer belt 16 at the primary transfer position from below. As the intermediate transfer belt 16 travels, the photosensitive drum 21A is rotated, and the primary transfer process is sequentially performed in the clockwise direction from the primary transfer position PA.

A downstream area of the primary transfer position PA on the photosensitive drum 21A is set to a first charge elimination area, and the charge of the photosensitive drum 21A is eliminated by the charge elimination part 25A. The charge elimination part 25A of the predetermined image forming unit 17A irradiates the downstream area of the primary transfer position PA on the photosensitive drum 21A with the post-transfer charge elimination light, and irradiates an upstream area of the primary transfer position PB on the photosensitive drum 21B of the other image forming unit 17B disposed on the downstream side of the predetermined image forming unit 17A in the conveyance direction with the pre-transfer charge elimination light. The post-transfer charge elimination light eliminates most of the electrostatic latent image on the surface of the photosensitive drum 21A after the primary transfer, and the pre-transfer charge elimination light eliminates the electrostatic latent image remaining on the surface of the photosensitive drum 21B before the primary transfer.

A downstream area of the first charge elimination position on the photosensitive drum 21A is set to a cleaning position, and the toner remaining on the photosensitive drum 21A is removed by the cleaning device 26A. A downstream area of the cleaning position on the photosensitive drum 21A is set to a charging position, and the surface of the photosensitive drum 21A is charged by the charger 22A. A downstream area of the charging position on the photosensitive drum 21A is set to an exposure position, and the electrostatic latent image is formed on the surface of the photosensitive drum 21A by the laser light from the exposure device 18 (see FIG. 1). A downstream area of the exposure position on the photosensitive drum 21A is set to a development position, and the toner is supplied to the surface of the photosensitive drum 21 by the development device 23A.

A downstream area of the development position on the photosensitive drum 21A, that is, an upstream area of the primary transfer position PA on the photosensitive drum 21A, is set to the second charge elimination position, but the photosensitive drum 21A disposed at the most upstream side in the conveyance direction is not irradiated with the pre-transfer charge elimination light. It should be noted that a charge elimination part (not shown) may be disposed in front of the photosensitive drum 21A, and the photosensitive drum 21A may be irradiated with pre-transfer charge elimination light from the charge elimination part. As described above, the second charge elimination position on the photosensitive drum 21B is irradiated with the pre-transfer charge elimination light from the charge elimination part 25A. The electrostatic latent image, which cannot be completely eliminated by the pre-transfer charge elimination light, is eliminated from the surface of the photosensitive drum 21B.

An area from the primary transfer position PA to the exposure position separated from the primary transfer position PA by substantially half the circumference of the photosensitive drum 21A in the clockwise direction is on the downstream side of the primary transfer position PA, and an area from the primary transfer position PA to the exposure position separated from the primary transfer position PA by substantially half the circumference of the photosensitive drum 21A in the counterclockwise direction is on the upstream side of the primary transfer position PA. On the downstream side of the primary transfer position PA, the first charge elimination position, the cleaning position, and the charging position are located, and on the upstream side of the primary transfer position PA, the second charge elimination position and the development position are located. The position of the primary transfer process is not particularly limited, and it is sufficient that at least the first charge elimination position is located on the downstream side of the primary transfer position PA and the second charge elimination position is located on the upstream side of the primary transfer position PA.

A first slit 42A is formed in the drum frame 41A of the predetermined image forming unit 17A, and a second slit 46B is formed in a development device frame 45B supporting the development device 23B of the other image forming unit 17B. The first slit 42A and the second slit 46B form a slit part for narrowing the irradiation width of the pre-transfer charge elimination light in the circumferential direction of the photosensitive drum 21B between the predetermined image forming unit 17A and the other image forming unit 17B. By the first slit 42 and the second slit 46, the irradiation width of the pre-transfer charge elimination light in the circumferential direction of the photosensitive drum 21B is gradually narrowed to the target width.

As shown in FIG. 3, a plurality of (in this embodiment, four) first slits 42A are formed in a row along the axial direction of the photosensitive drum 21A (the left-and-right direction) on the upper portion of the drum frame 41A. The first slit 42A has a larger slit length in the left-and-right direction and a narrower slit width in the upper-and-lower direction. When the pre-transfer charge elimination light passes through the first slit 42A, the irradiation angle of the pre-transfer charge elimination light in the upper-and-lower direction is narrowed, and the spread of the pre-transfer charge elimination light in the upper-and-lower direction is narrowed. The irradiation angle is a so-called ½ irradiation angle, and is an angle range of ½ or more of the maximum illuminance of the illuminance distribution.

A plurality of second slits 46B are formed on the upper portion of the development device frame 45B so as to face the plurality of first slits 42A. The second slit 46B has a slit length larger than that of the first slit 42A in the axial direction of the photosensitive drum 21B (the left-and-right direction). Therefore, the photosensitive drum 21B (see FIG. 2) is uniformly irradiated with the pre-transfer charge elimination light in the left-and-right direction. Between the second slits 46B, support walls 47B inclined in the left-and-right direction are provided. Therefore, the shaded area generated by shielding the pre-transfer charge elimination light by the support wall 47B is reduced, and the photosensitive drum 21B is uniformly irradiated with the pre-transfer charge elimination light in the left-and-right direction.

When the pre-transfer charge elimination light passes through the second slit 46B, the irradiation angle of the pre-transfer charge elimination light is narrowed in the upper-and-lower direction, and the spread of the pre-transfer charge elimination light passing through the first slit 42A is narrowed in the upper-and-lower direction. In this manner, the irradiation angle of the pre-transfer charge elimination light is roughly narrowed by the first slit 42A disposed away from the photosensitive drum 21B, and the irradiation angle of the pre-transfer charge elimination light is finely narrowed by the second slit 46B disposed near the photosensitive drum 21B. The irradiation width of the pre-transfer charge elimination light is narrowed by the first slit 42A and the second slit 46B, and the light quantity of the pre-transfer charge elimination light to the photosensitive drum 21B is mechanically adjusted.

As shown in FIG. 4, a board 51A of the charge elimination part 25A is supported by the drum frame 41A. The board 51A is formed long along the photosensitive drum 21A. A plurality (in this embodiment, eight) of a first charge elimination light sources 52A and a plurality (in this embodiment, four) of a second charge elimination light sources (charge eliminating light sources) 53A are arranged in a row along the board 51A. The emission surface of the first charge elimination light source 52A is directed toward the photosensitive drum 21A, and the emission surface of the second charge elimination light source 53A is directed toward the photosensitive drum 21B. LEDs (Light Emitting Diodes) are used for the first and second charge elimination light sources 52A and 53A. The first charge elimination light source 52A irradiates the post-transfer charge elimination light to the photosensitive drum 21A, and the second charge elimination light source 53A irradiates the pre-transfer charge elimination light to the photosensitive drum 21B.

The first slit 42A and the second slit 46B are provided corresponding to the second charge elimination light source 53A. The first slit 42A and the second slit 46B are formed such that the slit lengths of the first slit 42A and the second slit 46B in the left-and-right direction are large so as to allow the spread of the pre-transfer charge elimination light in the left-and-right direction. Normally, the illuminance of the pre-transfer charge elimination light from the second charge elimination light source 53A decreases as it separates away from the optical axis, but the pre-transfer charge elimination lights from the plurality of second charge elimination light sources 53A interfere with each other to suppress the decrease in illuminance. At this time, the spaces between the plurality of second charge elimination light sources 53A are adjusted such that the surface of the photosensitive drum 21B has uniform illuminance in the left-and-right direction.

Figure 5:
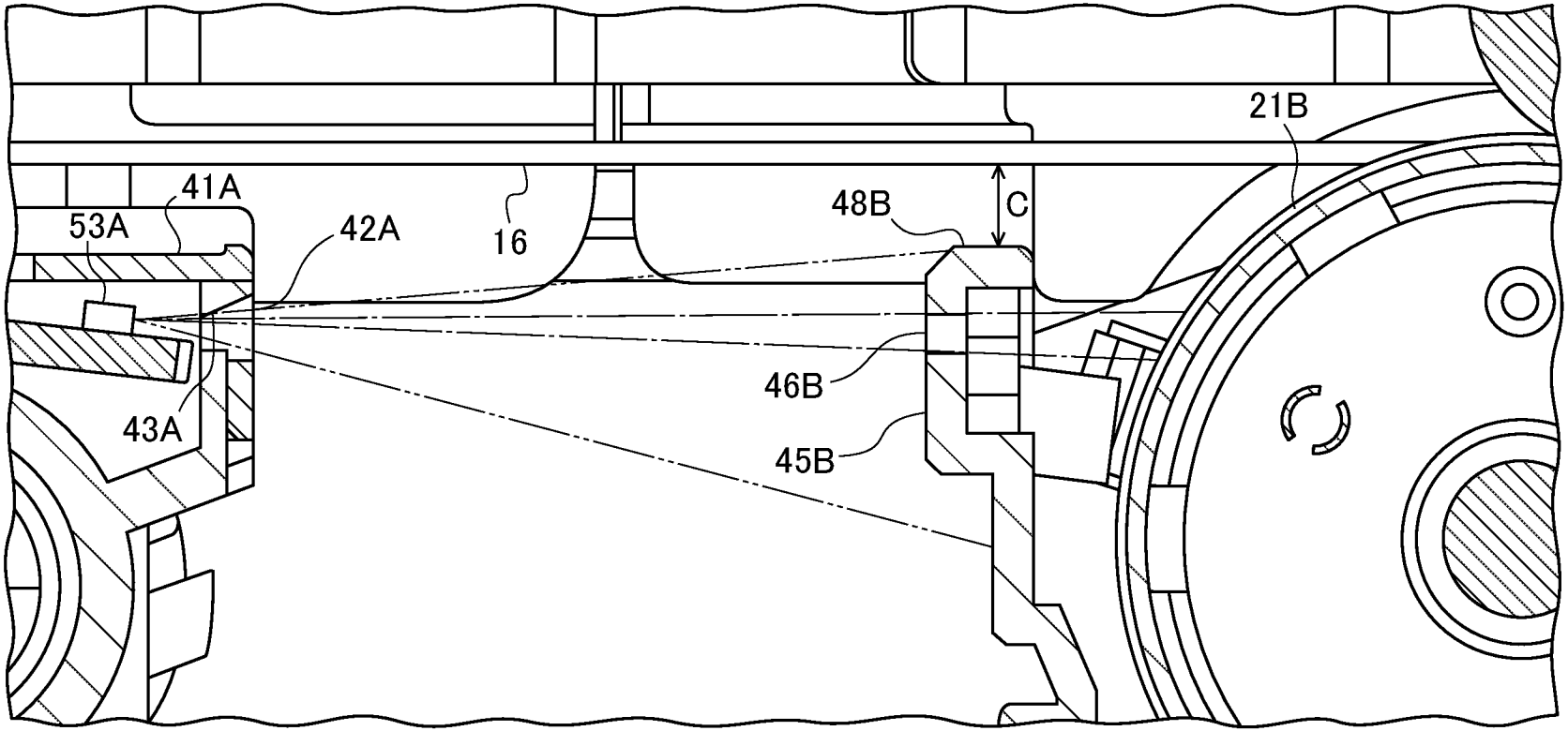
FIG. 5 is a view schematically showing a light shielding structure for pre-transfer charge elimination light according to the present embodiment.

With reference to FIG. 5, the light shielding structure of the pre-transfer charge elimination light will be described. FIG. 5 is a view schematically showing the light-shielding structure of the pre-transfer charge elimination light according to the present embodiment.

As shown in FIG. 5, the pre-transfer charge elimination light directed from the second charge elimination light source 53A to the photosensitive drum 21B is shielded by the first slit 42A of the drum frame 41A and the second slit 46B of the development device frame 45B. At this time, a gap C is formed between the development device frame 45B and the intermediate transfer belt 16 so that the development device frame 45B and the intermediate transfer belt 16 do not come into contact with each other. The gap C is set in a light shielding necessary region so that the photosensitive drum 21B is not irradiated with the pre-transfer charge elimination light through the gap C. Therefore, the first slit 42A narrows the irradiation angle of the pre-transfer light elimination light to suppress the pre-transfer light elimination light from entering the gap C.

More specifically, the optical axis of the second charge elimination light source 53A is inclined downward with respect to the horizontal, and the upper side of the pre-transfer charge elimination light is shielded by the upper edge 43A of the first slit 42A. When the pre-transfer charge elimination light passes through the first slit 42A, the upward spread of the pre-transfer charge elimination light is suppressed, and the pre-transfer charge elimination light is shielded by the upper portion of the development device frame 45. The upward spread of the pre-transfer charge elimination light is suppressed by the upper edge 43A of the first slit 42A to be lower than the upper surface 48A of the development device frame 45B. The upper edge 43A of the first slit 42A is designed with an accuracy of ±0.1 mm in order to secure the light shielding necessary area.

The second slit 46B further narrows the irradiation angle of the pre-transfer charge elimination passed through the first slit 42A, thereby narrowing the irradiation width of the pre-transfer charge elimination light in the circumferential direction of the photosensitive drum 21B to the target width. In this manner, the irradiation angle of the pre-transfer charge elimination light is roughly narrowed by the first slit 42A, the irradiation angle of the pre-transfer charge elimination light is finely narrowed by the second slit 46B, and the irradiation width of the pre-transfer charge elimination light to the photosensitive drum 21B is gradually narrowed to the target width. Further, since the first slit 42A is formed in the drum frame 41A and the second slit 46B is formed in the development device frame 45B, the light shielding structure is formed without providing any new components.

As described above, according to the present embodiment, the photosensitive drums 21 of the plurality of image forming units 17 are irradiated with the post-transfer charge elimination lights from the charge elimination parts 25. In addition, the charge elimination part 25A of the predetermined image forming unit 17A among the plurality of image forming units 17 irradiates the photosensitive drum 21B of the other image forming unit 17B with the pre-transfer charge elimination light. At this time, the photosensitive drum 21B is irradiated with post-transfer charge elimination light and pre-transfer charge elimination light, and the electrostatic latent image remaining on the surface of the photosensitive drum 21B is eliminated to prevent the transfer failure of the toner image. Further, the irradiation width of the pre-transfer charge elimination light to the photosensitive drum 21B is mechanically narrowed by the first slit 42A and the second slit 46B. Therefore, the photosensitive drum 21B can be irradiated with the pre-transfer charge elimination light having a suitable light amount using a mechanical structure to prevent the transfer failure.

In the present embodiment, although the first slit and the second slit are provided as the slit part, the slit part may be formed between the image forming units so as to narrow the irradiation width of the pre-transfer charge elimination light in the circumferential direction of the photosensitive drum. For example, the slit part may be formed by a single slit.

Further, in the present embodiment, although the first slit is formed in the drum frame and the second slit is formed in the development device frame, the first slit may be formed in a member other than the drum frame and the second slit may be formed in a member other than the development device frame.

Further, in the present embodiment, although the plurality of first and second charge elimination light sources are provided in the charge elimination part, the charge elimination part may be formed so as to eliminate the charge of the photosensitive drum by the charge elimination light. For example, a photoconductor along the photosensitive drum may be provided on the board of the charge elimination part, and the charge elimination light may be incident on the end surface of the photoconductor from the charge elimination light source. The photosensitive drum is irradiated with the post-transfer charge elimination light from the front surface of the photoconductor, and the other photosensitive drum is irradiated with pre-transfer charge elimination light from the back surface of the photoconductor.

In the present embodiment, the sheet may be in the form of a sheet on which an image to be formed, and may be a plain paper, a coated paper, a tracing paper, or an overhead projector (OHP) sheet, for example.

In the present embodiment, a printer is shown as an example of the image forming apparatus, but the present invention is not limited to this configuration. The image forming apparatus may be a multifunction peripheral having a printing function, a copying function, a facsimile function, or the like in combination, in addition to a copying machine and a facsimile machine.

Although the present embodiment has been described, as another embodiment, the above-described embodiment and the modified embodiment may be wholly or partially combined.

The techniques of the present disclosure are not limited to the embodiments described above, and may be changed, replaced, or modified in various ways without departing from the spirit of the technical philosophy. Further, if the technical idea can be realized in another way by the progress of the technology or another technique derived from the technology, the method may be used. Accordingly, the claims cover all embodiments that may be included within the scope of the technical idea.

The invention claimed is:

1. An image forming apparatus comprising:

a transfer belt traveling in a predetermined conveyance direction; and a plurality of image forming units arranged in the conveyance direction, wherein the image forming unit includes:

a photosensitive drum rotating in contact with the transfer belt at a primary transfer position;

a development device which supplies toner to the photosensitive drum on an upstream side of the primary transfer position; and a charge elimination part which eliminates a charge of the photosensitive drum on a downstream side of the first transfer position, the charge elimination part of a predetermined image forming unit among the image forming units irradiates a downstream area of the primary transfer position on the photosensitive drum of the predetermined image forming unit with post-transfer charge elimination light and irradiates an upstream area of the primary transfer position on the photosensitive drum of the other image forming unit disposed on a downstream side of the predetermined image forming unit in the conveyance direction with pre-transfer charge elimination light, and a slit part is provided between the predetermined image forming unit and the other image forming unit for narrowing an irradiation width of the pre-transfer charge elimination light in a circumferential direction of the photosensitive drum, the slit part includes a first slit formed in the predetermined image forming unit and a second slit formed in the other image forming unit, and the first slit and the second slit gradually narrow the irradiation width of the pre-transfer charge elimination light in the circumferential direction of the photosensitive drum to a target width, and the first slit is formed in a drum frame supporting the photosensitive drum, and the second slit is formed in a development unit frame supporting the development device.

2. The image forming apparatus according to claim 1, wherein the charge elimination part includes a plurality of charge elimination light sources arranged along an axial direction of the photosensitive drum, the first slit and the second slit correspond to the charge elimination light sources, and a slit length of the second slit is larger than a slit length of the first slit in the axial direction of the photosensitive drum.

3. The image forming apparatus according to claim 2, wherein the charge elimination light sources are arranged so that the pre-transfer charge elimination light irradiated from the adjacent charge elimination light sources interfere with each other in the axial direction of the photosensitive drum to obtain uniform illuminance on the photosensitive drum.

4. The image forming apparatus according to claim 1, wherein optical axes of the charge elimination light sources are inclined downward with respect to a horizontal.

* * * * *